US011365909B2

(12) United States Patent
Smith et al.

(10) Patent No.: US 11,365,909 B2
(45) Date of Patent: Jun. 21, 2022

(54) VAPOR LEAK SEPARATION AND DETECTION SYSTEM

(71) Applicant: Rolls-Royce North American Technologies Inc., Indianapolis, IN (US)

(72) Inventors: Alan W. Smith, Greenwood, IN (US); Kerry J. Lighty, Plainfield, IN (US); Paul O'Meallie, Brownsburg, IN (US); Sean Morgan, Indianapolis, IN (US)

(73) Assignee: Rolls-Royce North American Technologies Inc., Indianapolis, IN (US)

( * ) Notice: Subject to any disclaimer, the term of this patent is extended or adjusted under 35 U.S.C. 154(b) by 218 days.

(21) Appl. No.: 16/898,931

(22) Filed: Jun. 11, 2020

(65) Prior Publication Data

US 2021/0389028 A1 Dec. 16, 2021

(51) Int. Cl.

| | |
|---|---|
| ***F25B 23/00*** | (2006.01) |
| ***F25B 7/00*** | (2006.01) |
| ***F01P 11/18*** | (2006.01) |
| ***F28D 15/02*** | (2006.01) |
| *F01P 3/22* | (2006.01) |

(52) U.S. Cl.

CPC ..... *F25B 23/006* (2013.01); *F01P 11/18* (2013.01); *F25B 7/00* (2013.01); *F28D 15/0266* (2013.01); *F01P 3/2285* (2013.01); *F25B 2500/22* (2013.01)

(58) Field of Classification Search

CPC ..... F25B 23/006; F25B 7/00; F25B 2500/22; F25B 2500/221; F25B 2500/222

See application file for complete search history.

(56) References Cited

U.S. PATENT DOCUMENTS

| | | | | |
|---|---|---|---|---|
| 2,675,493 | A | 4/1954 | Grobel | |
| 5,802,859 | A | 9/1998 | Zugibe | |
| 5,829,264 | A | 11/1998 | Ishigaki et al. | |
| 6,098,412 | A | 8/2000 | Porter et al. | |
| 6,424,062 | B1 | 7/2002 | Adelmann et al. | |
| 9,200,851 | B2 | 12/2015 | Campbell et al. | |
| 9,243,820 | B2 | 1/2016 | Park et al. | |
| 2006/0010899 | A1 | 1/2006 | Lifson et al. | |
| 2007/0193285 | A1 | 8/2007 | Knight et al. | |
| 2011/0058637 | A1 | 3/2011 | Campbell et al. | |
| 2012/0037352 | A1 * | 2/2012 | Osaka | B60H 1/00021 165/59 |

(Continued)

FOREIGN PATENT DOCUMENTS

| | | | | |
|---|---|---|---|---|
| DE | 102020117471 | A1 * | 1/2022 | |
| WO | WO-2017055016 | A1 * | 4/2017 | B60H 1/00385 |
| WO | WO-2017143018 | A1 * | 8/2017 | F25B 13/00 |

*Primary Examiner* — Miguel A Diaz

(74) *Attorney, Agent, or Firm* — Barnes & Thornburg LLP

(57) ABSTRACT

A cooling system includes a first cooling loop, a second cooling loop and a heat exchanger configured to transfer heat from the first cooling loop to the second cooling loop. The first cooling loop includes a vapor/liquid separation feature configured to separate vapor present in the first cooling loop due to a leak between the first cooling loop and the second cooling loop. The first cooling loop also includes a pressure sensor configured to detect an increase in pressure in the first cooling loop that may result from a leak of second coolant into the first cooling loop.

20 Claims, 3 Drawing Sheets

(56) References Cited

U.S. PATENT DOCUMENTS

| | | | | |
|---|---|---|---|---|
| 2012/0222438 | A1* | 9/2012 | Osaka | B60H 1/00764 62/126 |
| 2013/0298583 | A1* | 11/2013 | O'Donnell | B60H 1/323 62/115 |
| 2017/0191702 | A1* | 7/2017 | Petersen | F25B 45/00 |
| 2017/0191705 | A1* | 7/2017 | Sethi | F25B 41/39 |

* cited by examiner

VAPOR LEAK SEPARATION AND DETECTION SYSTEM

FIELD OF THE DISCLOSURE

The present disclosure relates generally to cooling systems for aerospace applications, and more specifically to a cooling system including a vapor leak separation and detection system for separating and detecting vapor that may appear in the cooling system as a result of a coolant leak.

BACKGROUND

Cooling systems are used in aerospace applications to remove heat from heat sources, for example, motors, generators, and other components that generate heat when operated. Such cooling systems typically include a cooling loop having a heat source; a working fluid or coolant configured to receive heat from the heat source; a heat exchanger configured to receive heat from the heated coolant and to reject the heat from the cooling system; a coolant pump configured to move the coolant; and a fluid conduit fluidly coupling the heat source, the heat exchanger, and the coolant pump, thereby enabling the coolant pump to move the coolant from the coolant pump to the heat source, from the heat source to the heat exchanger, and from the heat exchanger back to the pump.

In some cooling systems, the heat exchanger rejects heat directly to an environment surrounding the first cooling loop. In some other cooling systems, the heat exchanger rejects heat to a second cooling loop, which in turn rejects the heat to the environment. Such systems may use a first working fluid or coolant in the first cooling loop and a second working fluid or coolant in the second system, wherein the first coolant is better suited than the second coolant for transferring heat from the first heat source, and wherein the second coolant is better suited than the first coolant for transferring heat to the environment.

SUMMARY

The present disclosure may comprise one or more of the following features and combinations thereof.

According to an aspect of the present disclosure, a sealed cooling system for use in an aerospace application includes a first sealed cooling loop configured to operate at a first nominal working pressure, a second sealed cooling loop configured to operate at a second nominal working pressure, and a heat exchanger configured to exchange heat between the first cooling loop and the second cooling loop.

The first cooling loop includes a first fluid conduit, a first coolant configured to circulate through the first fluid conduit, a pump configured to circulate the first coolant, a heat source, a pressure sensor, and a controller. The first coolant is a liquid at the first nominal working pressure. The second cooling loop includes a second fluid conduit and a second coolant configured to circulate through the second fluid conduit. At least a portion of the second coolant is a liquid at the second nominal working pressure. The second coolant is a vapor at the first working pressure.

The coolant tank includes a liquid space and a gas space. The coolant tank also includes an inlet configured to receive the first coolant from a first cooling loop outlet of the heat exchanger, and an outlet in fluid communication with an inlet of the pump.

The pressure sensor is in fluid communication with the coolant tank and is configured to detect a pressure within the coolant tank. The controller is configured to determine the presence of a leak of second coolant from the second cooling loop into the first cooling loop through the heat exchanger when the pressure sensor has detected a pressure in the coolant tank in excess of a predetermined pressure or a rate of increase in pressure in excess of a predetermined rate.

Some embodiments include a vapor/liquid separator between and in fluid communication with the outlet of the heat exchanger and the inlet of the coolant tank, and further in fluid communication with a vent line fluidly coupled to the gas space of the coolant tank. In some embodiments, the vent line includes a flow restrictor between the vapor/liquid separator and the gas space of the coolant tank. In some embodiments, the vapor/liquid separator is a junction in the first fluid conduit. In some embodiments, an outlet section of the junction is oriented in a direction having a vertically upward component.

In some embodiments, the second cooling loop is a two-phase cooling loop, and the second coolant is a two-phase fluid at the second nominal working pressure.

Some embodiments include a tank pressure relief valve having an inlet in fluid communication with the gas space of the coolant tank, wherein the tank pressure relief valve is configured to open when a differential pressure between the inlet and the outlet of the tank pressure relief valve exceeds a predetermined pressure. In some embodiments, the tank pressure relief valve has an outlet in fluid communication with a capture vessel. In some embodiments, the capture vessel is an expandable vessel.

In another aspect of the disclosure, a cooling system includes a first salad cooling loop, a second sealed cooling loop, and a heat exchanger configured to exchange heat between the first sealed cooling loop and the second sealed cooling loop. The first cooling loop includes a first fluid conduit, a first coolant, a pump configured to move the first coolant through the first fluid conduit, and a heat source configured to transfer eat to the first fluid conduit. A working pressure and temperature of the first cooling loop are such that the first coolant is a liquid in the first cooling loop. The second cooling loop includes a second fluid conduit and a second coolant configured to move through the second fluid conduit. A working pressure and temperature of the second cooling loop are such that at least a portion of the second coolant is a liquid in the second cooling loop. The liquid portion of the second coolant is configured to be in a vapor state if it enters the first cooling loop.

The first cooling loop also includes a coolant tank having a gas space and a liquid space configured to hold a portion of the first coolant. The coolant tank also includes an inlet configured to receive the first coolant from a first cooling loop outlet of the heat exchanger, and an outlet in fluid communication with an inlet of the pump.

The first cooling loop further includes a pressure sensor and a controller. The pressure sensor is in fluid communication with the coolant tank and is configured to detect a pressure within the coolant tank. The controller is configured to determine the presence of a leak of second coolant from the second cooling loop into the first cooling loop through the heat exchanger when the pressure sensor has detected a pressure in the coolant tank in excess of a predetermined pressure or a rate of increase in pressure in excess of a predetermined rate.

Some embodiments include a vapor/liquid separator between and in fluid communication with the outlet of the heat exchanger and the inlet of the coolant tank, and further in fluid communication with a vent line fluidly coupled to the gas space of the coolant tank. In some embodiments, the vent line includes a flow restrictor between the vapor/liquid separator and the gas space of the coolant tank. In some embodiments, the vapor/liquid separator is a junction in the first fluid conduit. In some embodiments, an outlet section of the junction is oriented in a direction having a vertically upward component.

In some embodiments, the second cooling loop is a two-phase cooling loop, and the second coolant is a two-phase fluid at the second nominal working pressure.

In a further aspect of the disclosure, a method for separating vapor from liquid in a cooling system includes providing a first sealed cooling loop including a first conduit, a first coolant, a pump configured to move the first coolant through the first conduit, a heat source configured to transfer heat to the first coolant, and a coolant tank defining a liquid space and a gas space, wherein a working pressure and temperature of the first sealed cooling loop is such that the first coolant is in a liquid state in the first sealed cooling loop; providing a second sealed cooling loop that includes second conduit and a second coolant configured to move through the second conduit, wherein a working pressure and temperature of the second coolant cooling loop is such that the second coolant is in a liquid state in the second sealed cooling loop, and wherein the second coolant is configured to change state from the liquid state to a vapor state if the second coolant enters the first sealed cooling loop; providing a heat exchanger in fluid communication with the first conduit and the second conduit and configured to exchange heat between the first coolant and the second coolant; providing a pressure sensor configured to detect pressure with the coolant tank; and providing a controller configured to determine the presence of a leak of second coolant from the second cooling loop into the first cooling loop through the heat exchanger when the pressure sensor detects pressure within the coolant tank in excess of a predetermined threshold value or a rate of pressure increase within the coolant tank in excess of a predetermined rate.

In some embodiments, the method includes providing a vapor/liquid separator in fluid communication with the first conduit downstream of the heat exchanger and upstream of the coolant tank. In some embodiments, the vapor/liquid separator comprises a junction having an outlet section oriented in a direction having a vertical component. In some embodiments, the controller is configured to regulate the operation of the heat source when the pressure in the first sealed cooling loop exceeds a threshold value.

These and other features of the present disclosure will become more apparent from the following description of a number of non-limiting, illustrative embodiments.

DETAILED DESCRIPTION OF THE DRAWINGS

Figure 1:
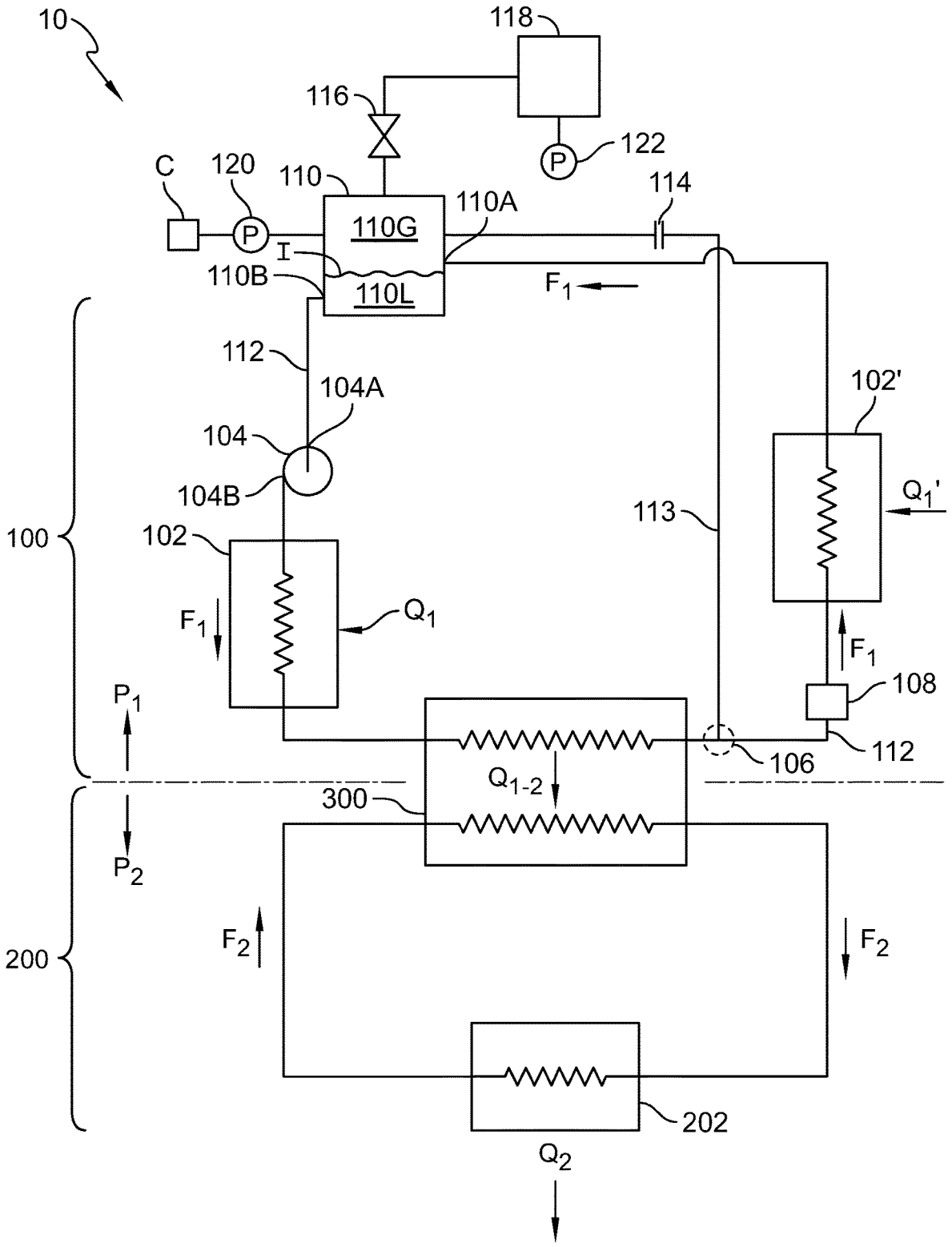
FIG. 1 is a diagrammatic view of a cooling system including a first sealed cooling loop operating at a first nominal temperature and pressure and using a first coolant as a working fluid, a second sealed cooling loop operating at a second nominal temperature and pressure and using a second coolant as a working fluid, a heat exchanger configured to exchange heat between the first sealed cooling loop and the second sealed cooling loop, and a vapor leak diversion system for separating second coolant vapor that may be present in the first sealed cooling loop from the first coolant according to the present disclosure.

For the purposes of promoting an understanding of the principles of the disclosure, reference will now be made to a number of illustrative embodiments illustrated in the drawings and specific language will be used to describe the same.

Figure 2:
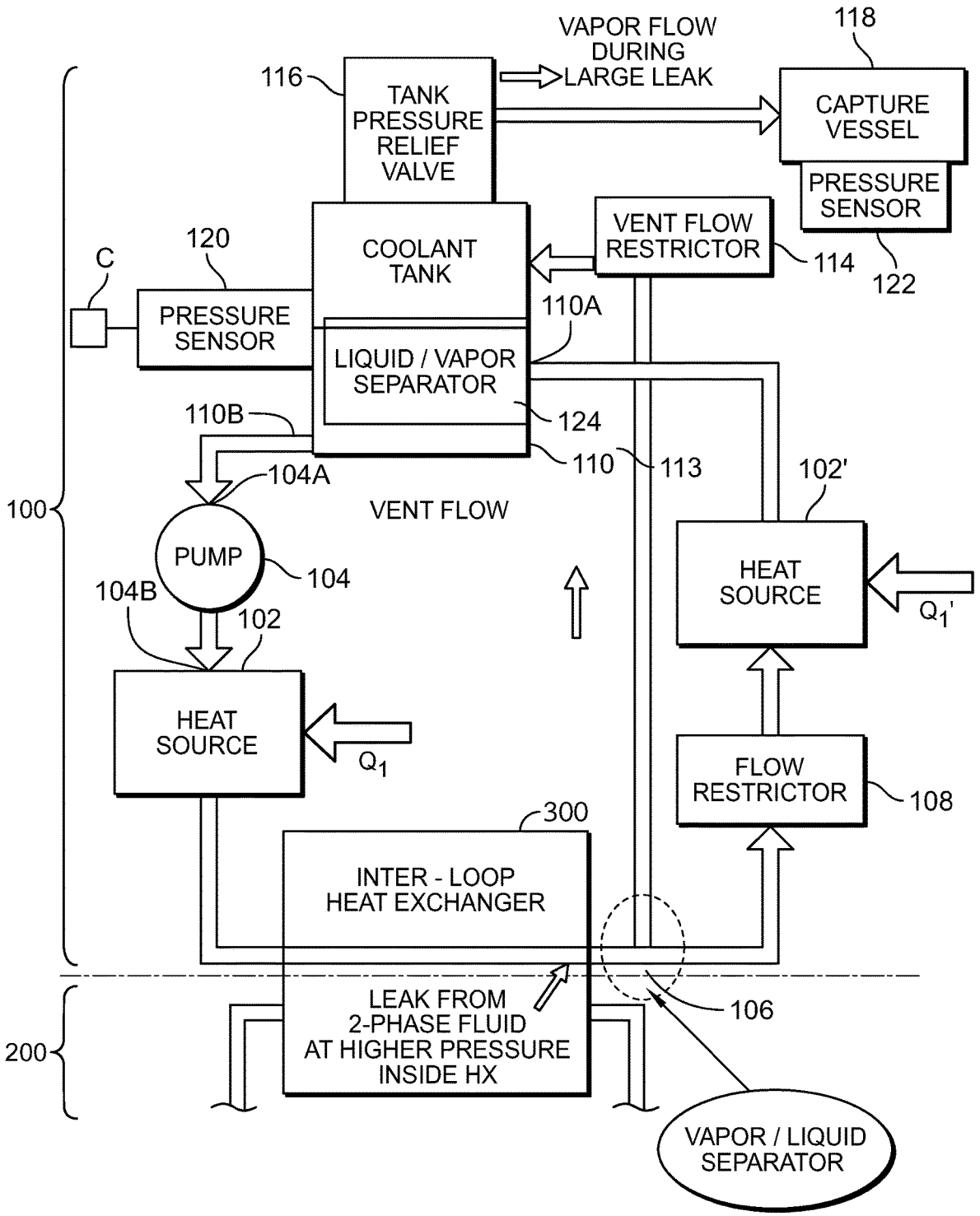
FIG. 2 is a schematic view of a portion of the cooling system of FIG. 1.

FIGS. 1 and 2 show an illustrative cooling system 10 according to the present disclosure. The cooling system 10 includes a first sealed cooling loop 100 (which may be hereinafter referred as the first cooling loop 100) using a first coolant as a working fluid. The first coolant may be, for example and without limitation, oil (for example, transformer oil), water, glycol, a water/glycol mixture, aviation fuel, or another suitable coolant. The cooling system 10 also includes a second sealed cooling loop 200 (which may be hereinafter referred to as the second cooling loop 200) using a second coolant as a working fluid. The second coolant may be, for example, and without limitation, a refrigerant (for example, R134), two-phase fluid, aviation fuel, compressed air or pressurized gas, or another suitable coolant.

The cooling system 10 further includes a heat exchanger 300 having a first side in fluid communication with the first cooling loop 100 and a second side in fluid communication with the second cooling loop 200 so that the heat exchanger 300 may exchange heat between the first sealed cooling loop 100 and the second sealed cooling loop 200. The heat exchanger 300 includes a first cooling loop inlet 300A and a first cooling loop outlet 300B. In the embodiment shown, the heat exchanger 300 is configured to transfer heat $Q_{1-2}$ from the first coolant to the second coolant. By design, the first cooling loop 100 is sealed from the environment and from the second cooling loop 200. Similarly, by design, the second cooling loop 200 is sealed from the environment and from the first cooling loop 100.

As shown, the first cooling loop 100 includes a heat source 102 configured to transfer heat $Q_1$ to the first coolant; a second heat source 102' configured to transfer heat $Q_1'$ to the first coolant; a coolant pump 104; the first side of the heat exchanger 300; a vapor/liquid separator 106; a flow restrictor 108; a coolant tank 110; and a fluid conduit 112 interconnecting the heat source 102, the second heat source 102', the coolant pump 104, the first side of the heat exchanger 300, the vapor/liquid separator 106, the flow restrictor 108, and the coolant tank 110. As shown, the heat source 102 is downstream of the coolant pump 104, which is downstream of the coolant tank 110, which is downstream of the second heat source 102', which is downstream of the flow restrictor 108, which is downstream of the inertial separator 106, which is downstream of the heat exchanger 300, which is downstream of the pump 104. In some embodiments one or the other of the heat source 102 and the second heat source 102' may be omitted.

The coolant pump 104 includes an inlet 104A fluidly coupled to an outlet 110B of the coolant tank 110, as will be discussed further below, and an outlet 104B.

The vapor/liquid separator 106 is shown as a junction or intersection in the fluid conduit 112, the junction having an inlet section, a first outlet section aligned with the inlet section, and a second outlet section oriented at an angle to the inlet section and the first outlet section. The angle may be any angle up to 90 degrees, for example, 30 degrees, 60 degrees, or any greater or lesser angle between 1 degree and 90 degrees. As such, the vapor/liquid separator may resemble a "T" or a "Y". The junction is configured so that the inlet section and the first outlet section extend in a horizontal direction or in a direction having a horizontal component. The junction further is configured so that the second outlet section extends vertically upward or in a direction having a vertical upward component. As such, the vapor/liquid separator 106 may function as a buoyancy separator, an inertial separator, or both. In other embodiments, the vapor/liquid separator 106 may be another form of junction in the fluid conduit a cyclonic separator or any other device that uses buoyancy or fluid inertia or momentum to separate fluids having different densities based on the difference in their densities.

The flow restrictor 108 may be an orifice, a series of orifices, a filter, or any other device that substantial restricts fluid flow therethrough or that creates a substantial pressure drop of fluid flowing therethrough, as will be discussed further below. In some embodiments including the second heat source 102', the second heat source 102' may function as the flow restrictor 108. That is, the second heat source 102' may provide sufficient impediment to flow of the first coolant therethrough so as to cause the foregoing substantial pressure drop of fluid flowing therethrough. In such embodiments, the flow restrictor 108 may be omitted as a discrete element separate and apart from the second heat source 102'. In further embodiments, the flow restrictor 108 as well as any functional equivalent thereof may be omitted.

The portion of the first cooling loop 100 downstream of the flow restrictor 108 and upstream of the pump 104 may be referred to herein as the low-pressure side of the first cooling loop 100. The portion of the first cooling loop 100 downstream of the pump 104 and upstream of the flow restrictor 108 may be referred to herein as the high-pressure side of the first cooling loop 100. As such, the heat source 102, the first side of the heat exchanger 300, the vapor/liquid separator 106, and the flow restrictor 108 are located on the high-pressure side of the first cooling loop 100; and the second heat source 102' and the coolant tank 110 are located on the low-pressure side of the first cooling loop 100.

As shown, the coolant tank 110 is fluidly connected via the first conduit 112 to the low-pressure side of the first cooling loop 100. In some embodiments, the coolant tank 110 is located at an elevation higher than any or all of the heat source 102, the second heat source 102', the coolant pump 104, the heat exchanger 300, the vapor/liquid separator 106, and the flow restrictor 108.

The coolant tank 110 defines a liquid space 110L configured to hold liquid first coolant, a gas space 110G configured to hold coolant vapor or other gases, and an interface I between the liquid space 110L and the gas space 110G. Such coolant vapor may include first coolant vapor or second coolant vapor, as will be discussed further below. The liquid space 110L, the gas space 110G, and the location of the interface I may vary during operation of the cooling system 10, as will be discussed further below, and thus are not rigidly defined.

The liquid space 110L, the gas space 110G, and the location of the interface I may vary depending on coolant level, the orientation of the cooling system 10, and inertial loads placed on the first coolant. For example, the coolant level may vary based on fill level of the first coolant and thermal expansion and contraction of the first coolant. Also, with the cooling system 10 installed in an aircraft or other vehicle, the orientation of the cooling system 10 may vary as a function of the orientation of the aircraft or other vehicle. Further, the orientation of the first coolant and the interface I in the coolant tank 110 may vary as a function of inertial loads placed on the first coolant, for example, due to acceleration of the aircraft or other vehicle in which the cooling system 10 is installed.

The coolant tank 110 includes an inlet 110A and an outlet 1108 fluidly coupled to the inlet 102A of the coolant pump 104. As shown, the inlet 110A is located above the interface I. In some embodiments, and/or under some operating conditions, the inlet 110A could be located below the interface I. During normal operation of the cooling system 10, the outlet 1108 is located below the interface I.

As shown, the first cooling loop 100 further includes a vent line 113 including a vent flow restrictor 114 having an inlet fluidly connected to the vapor/liquid separator 106, and an outlet fluidly connected to the coolant tank 110. The vent flow restrictor 114 may be embodied, for example, as an orifice. In some embodiments, the outlet of the vent flow restrictor 114 is fluidly connected to the gas space of the coolant tank 110. In other embodiments, the outlet of the vent flow restrictor 114 may be fluidly coupled to another portion of the coolant tank 110 or another portion of the low-pressure side of the first cooling loop, for example, to the fluid conduit 112 upstream of the pump 104. In further embodiments, the outlet of the vent flow restrictor 114 may be vented to the atmosphere or another environment. In some embodiments, the vent line 113 and the vent flow restrictor 114 may be omitted.

As shown, the first cooling loop 100 may also include a coolant tank pressure relief valve 116 having an inlet fluid connected to the gas space 110G of the coolant tank 110 and an outlet. The outlet of the coolant tank pressure relief valve 116 may be fluidly connected to a capture vessel 118. The capture vessel 118 may be a rigid tank or an expandable vessel, for example, an expandable balloon. Alternatively, the outlet of the coolant tank pressure relief valve 116 may be fluidly connected to the atmosphere or another environment. The first cooling loop 100 further includes a first pressure sensor 120 fluidly coupled to the coolant tank 110 and configured to detect and output a signal indicative of a pressure in the coolant tank 110. The output of the first pressure sensor 120 may be coupled to a controller C. The controller C may be configured to output an alarm signal if first pressure sensor 120 outputs a signal indicating that the pressure in the coolant tank 110 exceeds a predetermined pressure value or a rate of increase of pressure value exceeding a predetermined rate. Either of these conditions could indicate a leak of second coolant from the second cooling loop 200 into the first cooling loop 100, as will be discussed further below.

The controller C also may be configured to regulate the operation of either or both of the heat source 102 and the second heat source 102' to reduce the input of heat $Q_1$ and $Q_1'$ from the respective one of the heat source 102 and the second heat source 102' into the first coolant. In some embodiments, the controller C may be configured to output a signal indicative of a system low-volume leak.

In embodiments including the capture vessel 118, the first cooling loop 100 may also include a second pressure sensor 122 fluidly connected to the capture vessel 118 and configured to detect and output a signal indicative of pressure within the capture vessel 118.

The second cooling loop 200 includes the second side of the heat exchanger 300. The second cooling loop 200 also may include a second heat exchanger 202 configured to reject heat $Q_2$ from the second coolant to an environment outside the second cooling loop 200.

The first cooling loop 100 is configured to operate at a first nominal temperature and pressure. The first coolant is configured to be in a liquid state at the first nominal temperature and pressure. The first nominal pressure includes a relatively low first pressure on the low-pressure side of the first cooling loop 100, and a relatively high first pressure on the high-pressure side of the first cooling loop 100. Under normal operating conditions, the difference between the relatively low first pressure and the relatively high first pressure may be expressed as a first differential pressure.

The second cooling loop 200 is configured to operate at a second nominal temperature and pressure. The second coolant can be configured to be in a liquid state at the second nominal temperature and pressure, and to be in a vapor state at the first nominal temperature and pressure.

The second nominal pressure is substantially greater than the first nominal pressure. As such, the second coolant may migrate from the second cooling loop 200 into the first cooling loop 100 in the event of a leak between the first side of the heat exchanger 300 and the second side of the heat exchanger 300.

During normal operation of the cooling system 10 as shown, the coolant pump 104 circulates the first coolant through the fluid conduit 112, from the pump outlet 1048, through the heat source 102, the heat exchanger 300, the vapor/liquid separator 106, the flow restrictor 108, the second heat source 102', and the coolant tank 110, and to the pump inlet 104A. The second heat source 102' and the flow restrictor 108 inhibit flow of the first coolant so as create the first differential pressure between the high-pressure side and the low-pressure side of the first cooling loop 100.

The first differential pressure causes some amount of first coolant to bypass the second heat source 102' and the flow restrictor 108 and instead flow through the vent line 113 and the vent flow restrictor 114. The second heat source 102', the flow restrictor 108, and the vent flow restrictor 114 may be selected to provide a desired amount of bypass flow of first coolant through the vent line 113 and the vent flow restrictor 114. As suggested above, in some embodiments, the second heat source 102' may provide sufficient impediment to flow to yield a desired first differential pressure. In such embodiments, the second heat source 102' functions as the flow restrictor 108, and the flow restrictor 108 may be omitted as a separate and discrete element.

In the event that second coolant migrates from the second cooling loop 200 into the first cooling loop 100, the second coolant that has migrated into the first coolant loop 100 is expected to change state from the liquid state to the vapor state, and to increase the pressure in the first cooling loop 100. In some scenarios, the vaporized second coolant may increase the pressure in the first cooling loop 100 to a pressure exceeding the design pressure of the first cooling loop 100. Such a pressure increase in the first cooling loop 100 may compromise the structural integrity of components in the first cooling loop 100. For example, either or both of the heat source 102 and the second heat source 102' may include an internal first coolant pressure boundary that is susceptible to damage or failure if subjected to excessive pressure.

Also, the presence of vaporized second coolant (or other vapor) in the first cooling loop 100 may limit or otherwise compromise the ability of the first coolant to receive heat from the heat source 102 or the second heat source 102'. Further, the presence of vaporized second coolant (or other vapor) in the first cooling loop 100 may adversely affect electrical isolation of components in the first cooling loop 100. For example, the heat source 102 or the second heat source 102' may be a generator cooled by the first coolant, wherein the first coolant also serves as a dielectric between internal electrical components of the generator. Vaporized second coolant may have a substantially lower dielectric constant than the first coolant. As such, the presence of vaporized second coolant in the first cooling loop 100 may substantially reduce the electrical isolation between the electrical components of the generator.

To mitigate the foregoing deleterious effects, the first cooling loop 100 is operable to separate vapor in the first coolant loop 100 from the liquid first coolant, as will be discussed further below.

As mentioned above, the vent line 113 and vent flow restrictor 114 provide for continuous bypass flow of fluid around the second heat source 102' and the flow restrictor 108. During normal operation, the fluid flowing through the vent line 113 and the vent flow restrictor 114 typically would be purely liquid first coolant or liquid first coolant and an insignificant amount of vapor or gas.

In the event that second coolant were to leak into the first cooling loop and vaporize, as discussed above, the vaporized second coolant flowing through the vapor/liquid separator 106 would tend to separate from the main flow of liquid first coolant flowing through the flow restrictor 108 and the second heat source 102', and be diverted to and flow through the vent line 113 and the vent flow restrictor 114 to the coolant tank 110. This phenomenon would occur because of the buoyancy of the vaporized second coolant with respect to the liquid first coolant, as would be recognized by one skilled in the art, and because the second outlet section of the junction of the vapor/liquid separator 106 extends in a vertical direction or otherwise in a direction having a vertical component. This phenomenon also would occur because the vent flow restrictor 114 presents substantially less impediment to flow of vapor therethrough than liquid therethrough. As such, the vaporized second coolant ascending through the vent line 113 flows through the vent flow restrictor 114 more readily than does the liquid first coolant. As such, the inertial separator 106, the vent line 113 and the vent flow restrictor 114 cooperate to separate vaporized second coolant from the liquid first coolant, and to divert the separated vaporized second coolant through the vent line 113 and the vent flow restrictor 114 to the coolant tank 110.

The vaporized second coolant that has leaked into the first cooling loop 100 causes the pressure in the first cooling loop 100 to rise. The pressure of the low-pressure side of the first cooling loop 100 is monitored by the first pressure sensor 120. Should this pressure increase to a pressure value in excess of the coolant tank pressure relief valve 116 setpoint, the coolant tank pressure relief valve 116 opens, thereby allowing the vaporized second coolant (and/or other gas present in the coolant tank 110) to flow to the capture vessel 118 (or to be vented to the environment if no capture vessel is provided). The controller C may be configured to output a signal indicative of a system leak, for example, a system low-volume leak, under these circumstances. The pressure in the capture vessel 118 may be monitored by the second pressure sensor 122. Should the pressure in the capture vessel 118 exceed a predetermined pressure value, the capture vessel 118 may be selectively vented to the environment through a further pressure relief valve or other valve (not shown). The controller C may be configured to output a system high-volume leak warning under these circumstances.

As suggested above, the heat source 102 could be omitted. Such embodiments would be operable to separate vaporized second coolant from the liquid first coolant in the manner discussed above.

As suggested above, in some embodiments, the second heat source 102' could be omitted. Such embodiments would be operable to separate vaporized second coolant from the liquid first coolant in the manner discussed above.

As suggested above, in some embodiments both the second heat source 102' and the flow restrictor 108 could be omitted. In such embodiments, the fluid conduit 112 itself may provide sufficient impediment to flow compared to cause some of the first coolant to be diverted thorough the vent line 113 and the vent flow restrictor 114, as discussed above. Such embodiments would be operable to separate vaporized second coolant from the liquid first coolant in the manner discussed above.

In some embodiments, the second heat source 102', the vent line 113, and the vent flow restrictor could be omitted, such that all of the first coolant and any vaporized second coolant carried thereby is conveyed to the coolant tank 110 through the fluid conduit 112 extending between the heat exchanger 300 and the coolant tank 110. In such embodiments, the vapor/liquid separator 106 could be omitted, as well. In such embodiments, the vaporized second coolant may be separated from the liquid first coolant in the coolant tank 110 by way of buoyancy effects or simple gravitational force. Alternatively, as shown in FIG. 2, a discrete liquid/vapor separator 124, for example, one or more baffles, could be provided inside the coolant tank 110, and could be configured to separate or to further separate liquid first coolant from vaporized second coolant carried therewith.

Figure 3:
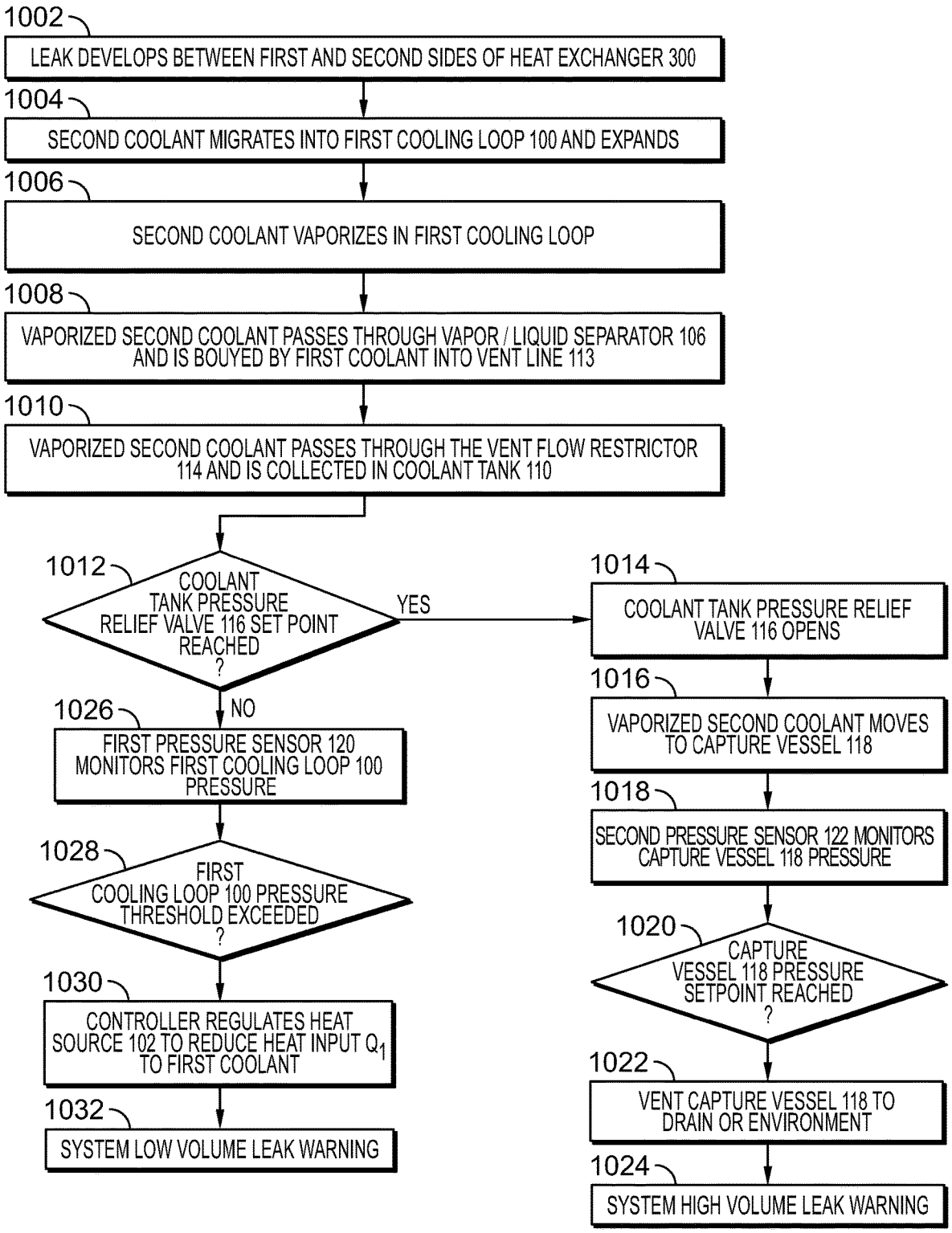
FIG. 3 is a flow chart showing a method of operating the cooling system of FIG. 1 to separate second coolant vapor that may be present in the first sealed cooling loop from the first coolant.

FIG. 3 illustrates a method of removing vaporized second coolant that has migrated from the second coolant loop 200 into the first cooling loop 100.

At Step 1002, a leak develops between the first and second sides of the heat exchanger 300.

At Step 1004, second coolant leaks from the second cooling loop 200 into the first cooling loop 100 and expands.

At Step 1006, the second coolant that leaked into the first cooling loop 100 vaporizes and increases the volumetric flow rate in the first cooling loop 100.

At Step 1008, the vaporized second coolant passes through the vapor/liquid separator 106 and is buoyed by the first coolant into the vent line 113.

At Step 1010, the vaporized second coolant passes through the vent flow restrictor 114 and is collected in the coolant tank 110.

At Step 1012, with the heat source bypass pressure relief valve 114 open, vaporized second coolant moves through the inertial separator 106 to the coolant tank 110, and liquid first coolant moves through the inertial separator 106 to the flow restrictor 108.

At Step 1014, the coolant tank pressure relief valve 116 opens if the coolant tank 110 pressure has risen beyond the coolant tank pressure relief valve 116 setpoint, or the coolant tank pressure relief valve 116 remains closed if the coolant tank 110 pressure has not risen beyond the coolant tank pressure relief valve 116 setpoint.

At Step 1016, with coolant tank pressure relief valve 116 open, second coolant vapor or other pressurized gas in the coolant tank 110 moves to the capture vessel 118 (or to a drain or the environment if no capture vessel is provided).

At Step 1018, the second pressure sensor 122 monitors the pressure within the capture vessel 118.

At Steps 1020 and 1022, the capture vessel 118 is isolated if the capture vessel 118 pressure is at or below a predetermined value, and the capture vessel 118 is vented to a drain or the environment if the capture vessel 118 pressure is exceeds the predetermined value.

At Steps 1024, the controller C outputs a system high-volume leak warning.

At Step 1026, the first pressure sensor 120 monitors pressure in the first cooling loop 100.

At Steps 1028 and 1030, a controller C regulates the operation of the heat source 102 to reduce the input of heat $Q_1$ from the heat source to the first coolant if the pressure in the low-pressure side of first cooling loop 100 exceeds a threshold value.

At Step 1032, the controller C outputs a system low-volume leak warning.

In embodiments lacking the vent line 113 and the vent flow restrictor 114, Step 1008 above may be omitted and bypassed.

An illustrative cooling system according to the present disclosure may include a first cooling loop operating at a first nominal pressure, a second cooling loop operating at a second nominal pressure higher than the first nominal pressure, and a heat exchanger configured to exchange heat between the first cooling loop and the second cooling loop. The first cooling loop may use an incompressible fluid, for example, oil or PGW, as a first coolant, and the second cooling loop may use a highly volatile two-phase fluid as a second coolant.

The cooling system may be configured so that second coolant leaks from the second cooling loop into the first cooling loop in the event of an inter-loop leak in the heat exchanger. The second coolant that has leaked into the first cooling loop vaporizes in the first cooling loop and increases the pressure in the first cooling loop. The pressure in the first cooling loop could reach the pressure in the second cooling loop.

The cooling system is configured to mitigate such a leak by collecting and capturing the vaporized second coolant in a coolant tank in the first cooling loop, which coolant tank acts as a vapor separator.

A pressure sensor may be associated with the coolant tank and configured to detect the pressure within the coolant tank.

A pressure relief valve may be provided to vent a gas space of the coolant tank in the event the coolant tank pressure exceeds a corresponding predetermined threshold pressure. Such venting could be to a capture vessel. The capture vessel could be an expandable vessel, for example, a balloon. The balloon could function as a visual indicator of the leak.

The pressure sensor could be coupled to a controller configured to shut down or otherwise control the source of heat input to the first cooling loop in the event the coolant tank pressure exceeds a corresponding predetermined threshold pressure. Shutting down or reducing the heat input to the first cooling loop may reduce the magnitude of the leak of second coolant into the first cooling loop, for example, by reducing the heat transferred from the first cooling loop to the second cooling loop. Reducing the magnitude of the leak may mitigate the pressure increase in the coolant tank and the capture vessel. Shutting down or otherwise controlling the source of heat input to the first cooling loop, typically a piece of mechanical or electrical equipment, may also protect the source of heat from damage due to overheating in the event of a severe leak in which much or all of the second coolant is lost.

While the disclosure has been illustrated and described in detail in the foregoing drawings and description, the same is to be considered as exemplary and not restrictive in character, it being understood that only illustrative embodiments thereof have been shown and described and that all changes and modifications that come within the spirit of the disclosure are desired to be protected.

What is claimed is:

1. A cooling system including a vapor leak separation system, the cooling system comprising:

a first sealed cooling loop configured to operate at a first nominal working pressure, the first sealed cooling loop comprising:

a first fluid conduit;

a first coolant configured to circulate through the first fluid conduit, wherein the first coolant is a liquid at the first nominal working pressure;

a pump configured to circulate the first coolant through the first fluid conduit;

a heat source configured to transfer heat to the first coolant; and a coolant tank having a gas space configured to hold gas and a liquid space configured to hold a portion of the first coolant;

a second sealed cooling loop configured to operate at a second nominal working pressure greater than the first nominal working pressure, the second sealed cooling loop comprising:

a second fluid conduit;

a second coolant configured to circulate through the second fluid conduit, wherein at least a portion of the second coolant is a liquid at the second nominal working pressure and wherein the second coolant is a vapor at the first nominal working pressure;

a heat exchanger in fluid communication with the first sealed cooling loop and the second sealed cooling loop, the heat exchanger configured to exchange heat between the first sealed cooling loop and the second sealed cooling loop;

a pressure sensor in fluid communication with the coolant tank and configured to detect a pressure within the coolant tank; and a controller;

wherein the coolant tank comprises an inlet configured to receive the first coolant from a first cooling loop outlet of the heat exchanger, and an outlet in fluid communication with an inlet of the pump; and wherein the controller is configured to determine the presence of a leak of second coolant from the second sealed cooling loop into the first sealed cooling loop through the heat exchanger when the pressure sensor has detected a pressure in the coolant tank in excess of a first predetermined threshold value or a rate of increase in pressure in the coolant tank in excess of a predetermined threshold rate.

2. The cooling system of claim 1, wherein the second sealed cooling loop is a two-phase cooling loop, and wherein the second coolant is a two-phase fluid at the second nominal working pressure.

3. The cooling system of claim 1, wherein the controller is further configured to regulate the operation of the heat source to reduce heat input to the first coolant when the controller has determined the presence of the leak.

4. The cooling system of claim 1, further comprising a vapor/liquid separator between and in fluid communication with the outlet of the heat exchanger and the inlet of the coolant tank, the vapor/liquid separator further in fluid communication with a vent line fluidly coupled to the gas space of the coolant tank.

5. The cooling system of claim 4, wherein the vent line comprises a vent flow restrictor between the vapor/liquid separator and the gas space of the coolant tank.

6. The cooling system of claim 4, wherein the vapor/liquid separator is a junction in the first fluid conduit.

7. The cooling system of claim 6, wherein an outlet section of the junction is oriented in a direction having a vertically upward component.

8. The cooling system of claim 1, further comprising a tank pressure relief valve having an inlet in fluid communication with the gas space of the coolant tank, wherein the tank pressure relief valve is configured to open when a differential pressure between the inlet and the outlet of the tank pressure relief valve exceeds a second predetermined threshold value, wherein the second predetermined threshold value is greater than the first predetermined threshold value.

9. The cooling system of claim 8, wherein the tank pressure relief valve has an outlet in fluid communication with a capture vessel.

10. The cooling system of claim 9, wherein the capture vessel is an expandable vessel.

11. A cooling system including a vapor leak separation system, the cooling system comprising:

a first sealed cooling loop including a first fluid conduit, a first coolant, a pump configured to move the first coolant through the first fluid conduit, and a heat source configured to transfer heat to the first coolant;

a second sealed cooling loop that includes a second fluid conduit and a second coolant configured to move through the second fluid conduit;

a heat exchanger in fluid communication with the first fluid conduit and the second fluid conduit and configured to exchange heat between the first coolant and the second coolant, wherein a working pressure and temperature of the first sealed cooling loop is such that the first coolant is in a liquid state in the first sealed cooling loop, wherein a working pressure and temperature of the second sealed cooling loop is such that at least a portion of the second coolant is in a liquid state in the second sealed cooling loop, wherein the at least a portion of the second coolant is configured to change from the liquid state to a vapor state if the second coolant enters the first sealed cooling loop, and wherein the first sealed cooling loop further includes:

a coolant tank having a gas space configured to hold gas and a liquid space configured to hold a portion of the first coolant, the coolant tank comprising an inlet configured to receive the first coolant from a first cooling loop outlet of the heat exchanger, and an outlet in fluid communication with an inlet of the pump;

a pressure sensor configured to detect a pressure within the coolant tank; and a controller configured to determine the presence of a leak of second coolant from the second sealed cooling loop into the first sealed cooling loop through the heat exchanger when the pressure sensor has detected pressure in the coolant tank in excess of a predetermined threshold value or a rate of increase in pressure in the coolant tank in excess of a predetermined threshold rate.

12. The cooling system of claim 11, wherein the second sealed cooling loop is a two-phase cooling loop, and wherein the second coolant is a two-phase fluid at the working pressure and temperature of the second sealed cooling loop.

13. The cooling system of claim 11, further comprising a vapor/liquid separator between and in fluid communication with the outlet of the heat exchanger and the inlet of the coolant tank, the vapor/liquid separator further in fluid communication with a vent line fluidly coupled to the gas space of the coolant tank.

14. The cooling system of claim 13, wherein the vent line comprises a vent flow restrictor between the vapor/liquid separator and the gas space of the coolant tank.

15. The cooling system of claim 13, wherein the vapor/liquid separator is a junction in the first fluid conduit.

16. The cooling system of claim 15 wherein an outlet section of the junction is oriented in a direction having a vertically upward component.

17. A method for separating vapor from liquid in a cooling system, the method comprising:

providing a first sealed cooling loop including a first conduit, a first coolant, a pump configured to move the first coolant through the first conduit, a heat source configured to transfer heat to the first coolant, and a coolant tank defining a liquid space and a gas space, wherein a working pressure and temperature of the first sealed cooling loop is such that the first coolant is in a liquid state in the first sealed cooling loop;

providing a second sealed cooling loop that includes second conduit and a second coolant configured to move through the second conduit, wherein a working pressure and temperature of the second coolant cooling loop is such that the second coolant is in a liquid state in the second sealed cooling loop, and wherein the second coolant is configured to change state from the liquid state to a vapor state if the second coolant enters the first sealed cooling loop;

providing a heat exchanger in fluid communication with the first conduit and the second conduit and configured to exchange heat between the first coolant and the second coolant, providing a pressure sensor configured to detect pressure with the coolant tank; and providing a controller configured to determine the presence of a leak of second coolant from the second cooling loop into the first cooling loop through the heat exchanger when the pressure sensor detects pressure within the coolant tank in excess of a predetermined threshold value or a rate of pressure increase within the coolant tank in excess of a predetermined rate.

18. The method of claim 17, wherein the controller further is configured to regulate the operation of the heat source when the pressure in the first sealed cooling loop exceeds a threshold value.

19. The method of claim 17, further comprising providing a vapor/liquid separator in fluid communication with the first conduit downstream of the heat exchanger and upstream of the coolant tank.

20. The method of claim 19, wherein the vapor/liquid separator comprises a junction in the first conduit, the junction having a stem oriented in a direction having a vertically upward component.

* * * * *